United States Patent [19]

McDowell et al.

[11] Patent Number: 5,061,539

[45] **Date of Patent: * Oct. 29, 1991**

[54] VANDAL RESISTANT UPHOLSTERED SEAT

[76] Inventors: Keith A. McDowell, 3065 Rapidfall Ct., Belmont, Mich. 49306; Vaughn L. Clark, 1112 Tenth St., Martin, Mich. 49070

[ * ] Notice: The portion of the term of this patent subsequent to Apr. 17, 2007 has been disclaimed.

[21] Appl. No.: 509,876

[22] Filed: Apr. 16, 1990

Related U.S. Application Data

[63] Continuation of Ser. No. 159,829, Feb. 24, 1988, Pat. No. 4,917,931.

[51] Int. Cl.[5] ..... B32B 33/00; A47C 31/00

[52] U.S. Cl. ..... 428/85; 428/90; 428/95; 297/218; 297/441; 297/443

[58] Field of Search ..... 428/88, 90, 93, 95, 428/916, 85; 297/454, 455, 441, 444, 218

[56] References Cited

U.S. PATENT DOCUMENTS 3,919,444 11/1975 Shayman ..... 428/95

4,917,931 4/1990 McDowell et al. ..... 428/88

4,927,682 5/1990 Nagura et al. ..... 428/88

*Primary Examiner*—Jenna Davis

*Assistant Examiner*—Terrel Morris

*Attorney, Agent, or Firm*—Gossett Dykema

[57] ABSTRACT

A vandal resistant upholstered seat or seat insert comprises a substrate formed of a hard material such as plastic, fiberglass, steel or the like; a vertical pile fabric having a non-coated backing covering the outer surface of the seat insert, with the vertical pile fabric including a plurality of generally upright fibers embedded in a backing material, with the fibers and the backing material being formed such that the backing and vertical fibers are accessible to a liquid adhesive applied to the underside of the backing material; and a layer of high-strength adhesive permeating the backing material from the underside and bonding securely the backing material and upright fibers to the substrate, the adhesive providing a fabric to substrate bond that exceeds the tensile strength of the fabric itself or has a peeling strength of at least twenty-five (25) pounds per inch width of fabric.

5 Claims, 1 Drawing Sheet

VANDAL RESISTANT UPHOLSTERED SEAT

CROSS REFERENCE TO RELATED APPLICATION

This is a continuation of applicant's co-pending patent application, Ser. No. 159,829, filed 02-24-88 for VANDAL RESISTANT UPHOLSTERED SEAT, U.S. Pat. No. 4,917,931, issued 04-17-90.

BACKGROUND OF THE INVENTION

The invention relates to an upholstered seat insert for transportation seating that is resistant to cutting or damage from vandalism.

Seating used in public transportation vehicles can either be upholstered or unupholstered. Upholstered seating is more desirable, because it is generally considered to be more comfortable. Upholstered seating is usually padded with a foam padding and includes a fabric cover that gives the seat a warm, less slippery feel than a hard metal or fiberglass seating surface.

On the other hand, upholstered seats are susceptible to vandalism, which is a particularly significant factor in buses or transportation vehicles used for intra-city transportation. Padded seats formed of foam rubber or the like, which are covered by a fabric or simulated leather upholstery, are easily cut. Such cuts are readily visible and expose the interior portion of the seat for additional vandalism. Seats that have been vandalized in this manner have to be replaced at considerable expense.

A common construction for intra-city seating comprises a metal interior frame, a fiberglass or toher molded plastic shell mounted over the frame, and seat inserts mounted in recesses in the seat shell. Seat inserts also can fit on a seat structure and when so used are sometimes called seat "onserts". The term "seat inserts", as used herein, refers to both kinds of products. The seat inserts typically form the seat portion and back rest portion of the seat, with the shell forming the peripheral supports for the seat inserts. Typically, the shell forms a bench-type seat and seat inserts are located at each seating position. Seat inserts can be bolted or otherwise fastened to the shell.

The seat inserts typically are contoured to conform with the shape of a passenger seated on the seat. The seat inserts can be formed of fiberglass or other molded plastic, steel or other hard material. The insert can be unupholstered or can be covered with a simulated leather or woven cloth fabric. In the past, such constructions have been quite susceptible to vandalism by cutting or slashing.

Prior attempts have been made to develop vandal resistant upholstery. Attempts have been made to render padded upholstery vandal resistant by incorporating slash-resistant materials, such as metal fibers or a metal mesh into the covering material or into the upholstery padding. These have meet with less than satisfactory results.

As an alternative to a padded seat, upholstered seat inserts have been constructed without padding by fastening a conventional woven fabric directly to the hard substrate material by the use of a high strength adhesive. This structure provides some of the attributes of a traditionally upholstered seat, but the structure is not satisfactorily vandal resistant. Cuts by razor blades are visible, and this makes the threads of a woven fabric visible and accessible. Thus, the threads can be unravelled, and incisions can be opened. Further, the glue or adhesive must be applied lightly to one side of the fabric or it will "bleed" through the fabric to the exposed outer surface, changing the appearance and texture of the fabric. However, a less than thorough saturation of the fabric makes it possible to peel the fabric or at least some of the threads from the seat substrate.

An object of the present invention is to provide an improved upholstered seat insert that camouflages cuts and slashes and is quite resistant to peeling or separation of the upholstery fabric from the substrate.

SUMMARY OF THE INVENTION

In accordance with the present invention, an improved vandal resistant upholstered seat or seat insert comprises a seat insert substrate formed of a hard material such as plastic, fiberglass, steel or the like; an unbacked vertical pile fabric covering the outer surface of the seat insert, with the vertical pile fabric including a plurality of generally upright fibers embedded in a backing material, with the fibers and the backing material being formed such that the backing and vertical fibers are accessible to a liquid glue applied to the underside of the backing material; and an adhesive layer between the backing material and the substrate, penetrating the backing material and bonding and affixing the backing material and upright fibers to the substrate, the adhesive producing a fabric to substrate bond that resists and effectively prevents fabric peeling from the substrate. Preferably, the fabric to substrate bond either exceeds the tensile strength of the fabric itself or has a peeling strength of at least twenty-five pounds per inch width of fabric. Preferably, the vertical pile fabric includes a woven or non-woven backing formed of fibrous materials that are permeable by a liquid adhesive, and the vertical pile fibers are looped or woven into the backing. The adhesive permeates the backing and penetrates substantially through the backing, bonding the vertical pile fibers and virtually all of the fibers of the backing together and to the substrate material. The adhesive is applied so that it only saturates the backing and does not bleed or penetrate into the outer portions of the vertical pile fibers, so it does not adversely affect the appearance or texture of the vertical pile fabric.

Upholstery formed in this manner provides an attractive and comfortable seating surface, with the vertical pile fabric providing some cushioning and providing air passageways between the passenger and the substrate for cooling and comfort purposes. The plush pile fabric also is warm, attractive, and provides a comfortable frictional feel that prevents excessive sliding on the seat surface. With a properly contoured seat insert, the seating is more than adequately comfortable for the relatively short trips normally undertaken on intra-city public transportation.

When an attempt is made to vandalize the seating of the present invention by slashing the fabric with a razor blade or sharp cutting tool, even multiple cuts are virtually invisible, and the fabric remains securely bonded to the seat insert substrate and is not peelable or separable from the substrate. The vertical orientation of pile fibers is in a direction that is generally parallel to the angle of incidence of a cutting implement, thus minimizing the cutting of these fibers. Moreover, the fibers camouflage cuts to the backing material. The cutting implement can penetrate the bonded backing material, but the backing material is so thoroughly saturated and bonded by the adhesive to the substrate that there are virtually no loose edges of the backing to peel apart or separate. Further, the strength of the adhesive is so great that even if there were bits of the backing material or pile fabric that could be gripped, the fabric itself will tear before the backing will separate.

The present invention thus provides all of the benefits of a comfortable upholstered seat in an inexpensive structure that is virtually vandal resistant.

These and other features and advantages of the present invention are described in the detailed description below and shown in the appended drawings.

DETAILED DESCRIPTION OF PREFERRED EMBODIMENT

Figure 1:
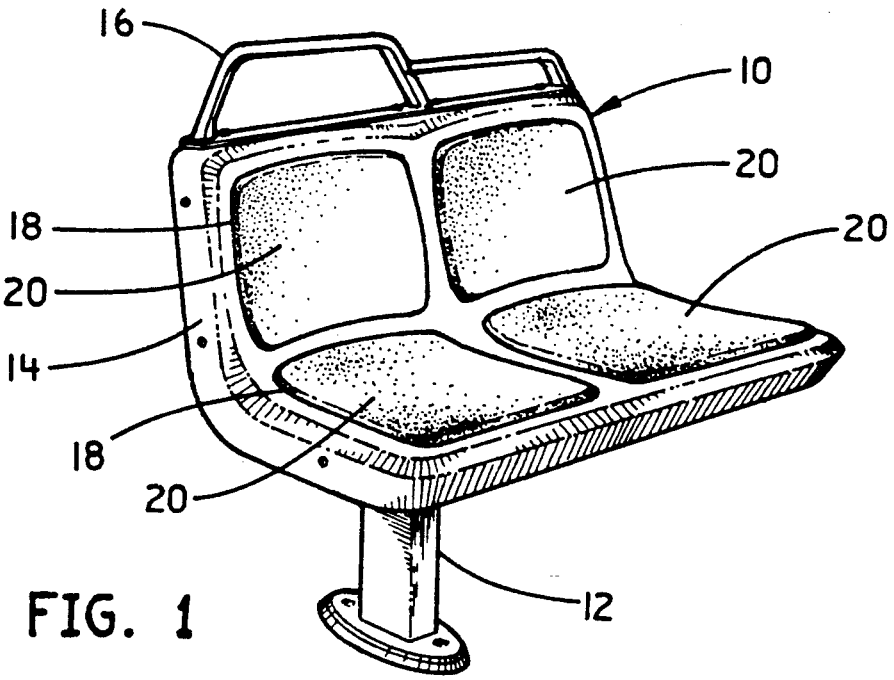
FIG. 1 is a perspective view of a typical public transportation seat employing seat inserts.

Referring to the drawings, a public transportation seat 10 is illustrated in FIG. 1. Seat 10 comprises a frame 12, the base of which is visible in FIG. 1, and a seat shell 14 that is mounted on the frame. The seat shell can be formed of a variety of materials but is typically formed of a moldable fiberglass or other plastic material in the positions. A grab rail 16 can be mounted on the upper edge of the back of the seat.

Figure 2:
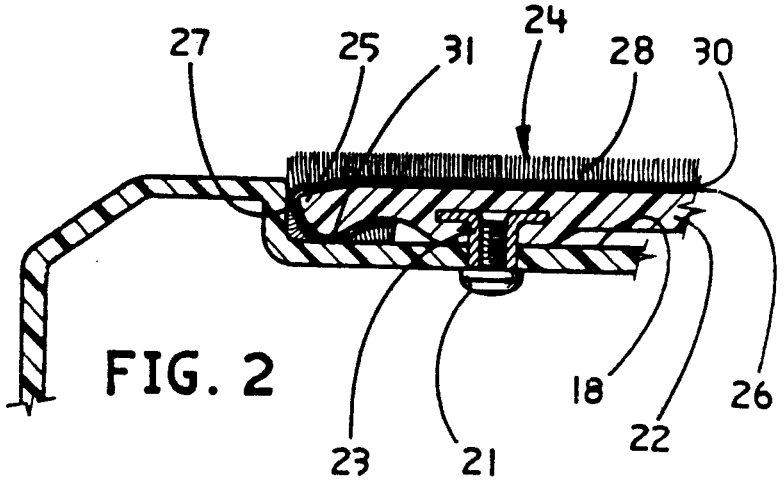
FIG. 2 is a fragmentary sectional view showing a portion of the upholstered seat insert of the present invention bolted in a fiberglass seat shell.
Figure 3:
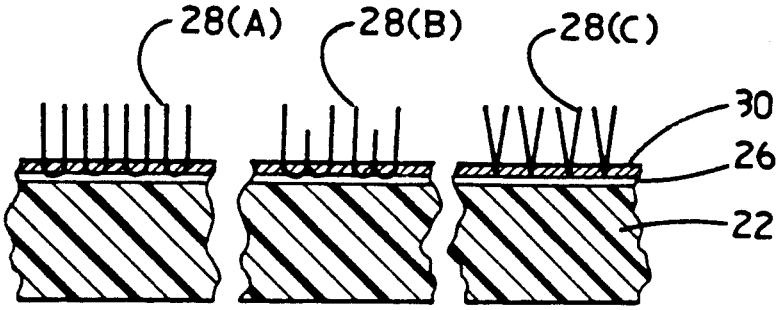
FIG. 3 is a cross sectional view of a portion of a seat insert of the present invention.

The shell has a plurality of seat insert recesses 18 (shown in part in FIG. 2) positioned in the seating and seat back areas of the individual seat positions, and seat inserts 20 are fastened in the seat insert openings in a conventional manner by bolts 21 or other mechanical fasteners that fit into T-fittings 23 or the like embedded in the lower side of the seat insert (FIG. 2). Seat inserts, whether or not they are upholstered, provide a means for enhancing the decorative appearance of the seat structure by the use of a seat insert of a contrasting color or by incorporating texture or other design characteristics into the seat insert. Covering the seat insert with a fabric makes it possible to create a wide variety of different appearances for different seating applications and customer preferences. The seat and seat back inserts typically are contoured to conform to the body of a passenger seated on the seat, so as to enhance the comfort of the seat.

The seat insert 20 of the present invention comprises a hard substrate 22 formed of a moldable fiberglass-reinforced polyester resin or other plastic resin. Steel or other substantially rigid, hard material could be used. The only requirement of the material is that it be compatible with a high strength glue or adhesive of the type that necessarily must be employed in the present invention.

The upholstery of the present invention comprises a layer of a vertical pile fabric 24 affixed to the substrate by a layer of high strength adhesive 26 that is sandwiched between the underside or inner side (the terms are used interchangeably) of the backing to the outer side or upper side of the seat insert. As shown in FIG. 2; the fabric extends over the edges 25 of the insert (which are spaced apart from the edge 27 of the recess) and extends inwardly on the underside of the insert. The underside of the insert has an arcuate portion 31.

Fabric 24 comprises a plurality of upright or vertical pile fibers 28 fixed at lower ends thereof in a generally flat, planer backing material 30. It is important that the lower end extremities of the pile fibers be accessible and contactible by an adhesive (preferably, a sprayable liquid adhesive) applied on the inner side of the backing material, so that the fibers and backing material are bonded together and both are bonded to the substrate. In this connection, it is important that the vertical pile fabric be different from conventionally available vertical pile fabrics. Conventional vertical pile fabrics are provided with a latex or other impermeable coating on the underside thereof. This coating is essential for most uses of vertical pile fabric and serves the additional purpose of bonding the pile fibers in the backing material. However, in the present invention, the adhesive must adhere directly to the backing itself and to the pile fibers in order to bond the fabric to the substrate with sufficient bonding strength, and the presence of a coating impairs this function and prevents adequate bonding of the fabric to the substrate.

With the requirement that the fabric be uncoated, a number of conventional vertical pile fabrics (often called "plushes") can be used. Typically, the backing is a woven or non-woven fibrous material, and the vertical pile fibers are woven or looped through the backing. One typical type of fabric is a so-called "cut loop" fabric, wherein two pieces of backing material are spaced apart parallel to each other and the pile fibers are looped back and forth through both layers of backing material. After the pile fibers have been looped through the backing sufficiently to provide the proper density of pile fibers, the two sections of backing material are separated by cutting the pile fibers at a position intermediate the two pieces of backing material. Since the pile fibers have been cut, this type of fabric is frequently referred to as cut pile fabric. The pile fibers may be looped in the backing material in the form of a "U", as illustrated by fibers 28(*a*); in the shape of a "W", as illustrated by fibers 28(*b*); or in the shape of a "V", as illustrated by fibers 28(*c*). All are conventional fabric construction techniques and are not part of the present invention.

While a variety of commercially available natural or synthetic pile fabrics can be used in the present invention, a combination 85% wool and 15% synthetic (nylon) pile fabric has good flammability, solvent resistance, and washability features. The length of the "nap", or the pile fibers, should be between about one-sixteenth (1/16) inch and three-eighths (⅜) inches, with the preferred length being about five thirty-seconds (5/32) inches. Shorter naps provide insufficient coverage for the backing and make adhesive bleed through a risk. Naps longer than three-eighths (⅜) inches tend to mat down in manufacture or use.

The length of the pile fibers is important, because the pile fibers must be sufficiently long to hide cut lines and to prevent adhesive from bleeding through the pile fibers. The pile fibers also provide air circulation through the fabric when the insert is in use and provide insulation from cold or hot temperatures that hard seating surfaces can sometimes present. The pile fabric also should be of a texture to provide an acceptable coefficient of friction for seat occupant retention.

The pile fabric 24 is securely affixed to the substrate by means of a high strength adhesive. As a minimum standard, it is desired that the fabric to substrate bond exhibit a peel (stripping) strength after being fully cured (which takes about seven days) exceeding the tensile strength of the fabric or a minimum bond strength of at least twenty-five (25) pounds per inch width of the fabric. It is physically difficult for an individual to manually exert a stripping force on a seat fabric that exceeds twenty-five (25) pounds per inch of fabric. Therefore, even if the tensile strength of the fabric is greater, it is unlikely that a person will be able to pull on the fabric hard enough to strip it from the substrate when this minimum bonding strength is achieved. It is also desired that the adhesive be resistant to common solvents, such as water, alcohol, aromatic and aliphatic hydrocarbons (i.e., gasoline, toluene, MEK, and the like) and that the glue be heat resistant up to 400° F. A two-part polyester resin glue manufactured by Bostic and comprising a linear saturated polyester base and a polyisocyanate curing compound has been found to be acceptable in the present invention. This adhesive must not only have the physical characteristics set forth above but must also have a viscosity that permits it to penetrate the fabric backing without bleeding through to the exterior of the pile fibers.

In constructing the seat inserts of the present invention, it is important that the adhesive be applied uniformly to the substrate and fabric backing and that sufficient adhesive be applied to saturate the backing without bleeding through the pile fibers. When the backing of the vertical pile fabric is formed of a woven or non-woven fibrous material, permeation by the adhesive can be accomplished readily. With the adhesive permeating the backing material and substantially saturating the backing material, there are no loose horizontal threads in the backing material that can be gripped and stripped from the backing material. Contrasting this structure to the prior attempts to minimize vandalism by gluing an unbacked woven fabric to a substrate, it was not possible to apply the glue to the extent that it saturated completely the fabric. This would have involved a complete bleed through of the glue to the exterior surface of the fabric and would have changed the appearance and texture of the fabric. To avoid this, the woven fabric had to be only partially coated with glue, so there were portions of the fabric that were not bonded by glue. The fact that a woven fabric comprises interwoven horizontally disposed fibers aggravated this problem, because, when a cut was made in the fabric, loose fiber ends became available for gripping and stripping, and the incomplete saturation of the fabric permitted fibers to be stripped from the surface of the seat insert, thus impairing the physical appearance of the insert and making the vandalism readily apparent.

After the adhesive has been applied to the substrate (which is textured or has been roughened or abraded to adhere to the adhesive) and to the backing in an amount sufficient to penetrate the backing without completely bleeding through the fabric, the glue is partially heat cured and the fabric pressed against the substrate uniformly until set. With the preferred adhesive, full curing takes several days at room temperature or several hours at an elevated temperature.

The foregoing represents an exemplary embodiment of the present invention. Various changes and modifications may be made in the details of the construction of this embodiment without departing from the spirit and scope of the present invention, as defined in the appended claims.

The embodiments of the present invention in which an exclusive property or privilege is claimed are defined as follows:

1. In a seat or seat insert comprising a hard substrate having an outer surface that a passenger contacts, the improvement comprising a vandal resistant upholstered surface for the seat, including:

a pile fabric covering the outer surface of the seat, the fabric comprising a permeable backing material with a plurality of generally upright fibers attached thereto and extending outwardly from an outer side thereof, the backing being free of any coating that prevents glue applied to the backing from permeating the backing; and a layer of high strength adhesive interposed between the pile fabric and the substrate, the adhesive at least partially permeating the backing of the fabric without materially impairing the visual appearance of the fabric from the other side, the adhesive bonding the fabric to the substrate with a bond strength sufficient to resist peeling of the fabric from the substrate, the bond strength being such that if upright fibers are grasped in an effort to peel the fabric from the substrate, the fibers will break before the backing will peel from the substrate.

2. A vandal resistant seat according to claim 1, wherein the substrate is formed of a polyester resin and the adhesive is a polyester resin, such that the substrate and adhesive become securely bonded together.

3. A vandal resistant seat according to claim 2, wherein the bond strength of the fabric to the substrate is at least twenty five (25) pounds per inch width of fabric.

4. A vandal resistant seat according to claim 3, wherein the pile fabric has woven backing.

5. A vandal resistant seat according to claim 3, wherein the backing is formed at least in part of synthetic fibers that are compatible with the adhesive.

* * * * *